United States Patent [19]

Cella

[11] 4,162,191

[45] Jul. 24, 1979

[54] MODULAR STEAM GENERATOR FOR USE IN NUCLEAR POWER PLANTS

[76] Inventor: Alexander Cella, Robinwood Dr., Great Notch, N.J.

[21] Appl. No.: 792,195

[22] Filed: Apr. 29, 1977

[51] Int. Cl.[2] ..... G21C 19/28

[52] U.S. Cl. ..... 176/65; 176/38; 122/34; 165/76

[58] Field of Search ..... 176/50, 60, 61, 65, 176/38; 122/32, 34, 511; 165/158, 163, 76

[56] References Cited

U.S. PATENT DOCUMENTS

| | | | |
|---|---|---|---|
| 698,290 | 4/1902 | Kelley | 165/158 |
| 1,372,010 | 3/1921 | Davis | 122/511 |
| 2,223,318 | 1/1940 | Gibb | 165/76 |
| 2,237,029 | 4/1941 | Fischer | 165/76 |
| 3,213,833 | 10/1965 | Cunningham et al. | 176/65 |
| 3,902,463 | 9/1975 | Michel | 165/158 |

FOREIGN PATENT DOCUMENTS

| | | | |
|---|---|---|---|
| 1335130 | 7/1963 | France | 165/158 |
| 1429336 | 3/1976 | United Kingdom | 165/158 |

*Primary Examiner*—Harvey E. Behrend

*Attorney, Agent, or Firm*—Hubbell, Cohen, Stiefel & Gross

[57] ABSTRACT

An improved steam generator for use in a nuclear power plant of the pressurized water type in which a turbine generator is driven by the steam output of the steam generator to provide electrical power therefrom. The improvement comprises providing vertically assemblable modules which are removably mounted together in sealing relationship, with the modules comprising a base module, a tube bundle module removably mountable on the base module in sealing relationship therewith and an uppermost dryer module removably mountable on the tube bundle module in sealing relationship therewith whereby ready access to and removal of the tube bundle module in situ from the nuclear power plant steam generator is facilitated. The dryer module contains moisture separator means within the interior thereof in communication with a steam outlet for drying the generated steam provided to the steam outlet to the turbine generator. The base module, upon which the associated weight of the vertically assembled dryer module and tube bundle module are supported, contains the inlet and outlet for the heat exchange fluid. The tube bundle module contains the tube bundle through which the heat exchange fluid flows as well as an inlet for feedwater. The tube sheet in which the tube bundle is supported also serves as a closure flange for the tube bundle module, with the associated weight of the vertically assembled dryer module and tube bundle module on the tube sheet closure flange effectuating the sealing relationship between the base module and the tube bundle module for facilitating closure.

8 Claims, 7 Drawing Figures

FIG. 2.
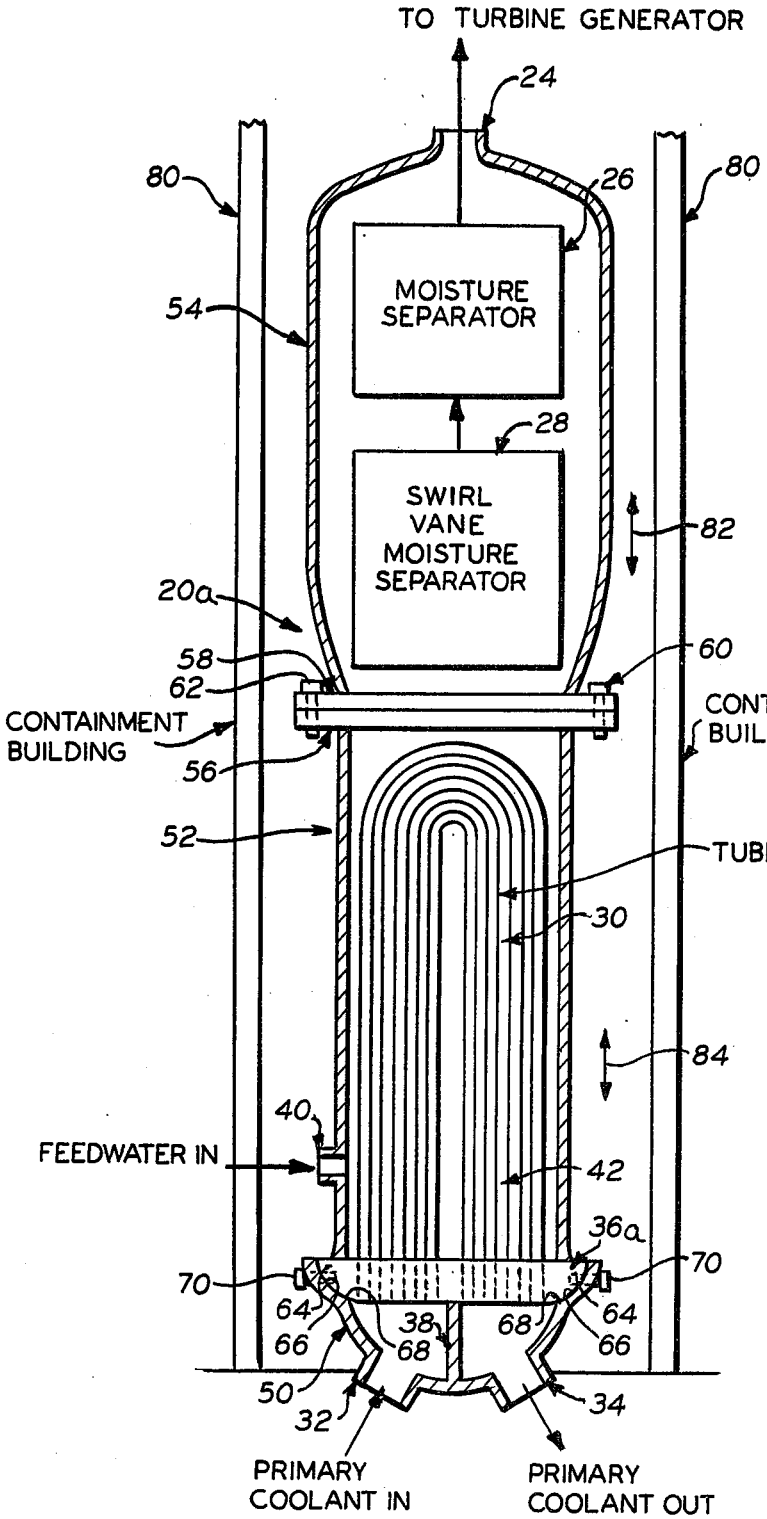
FIG. 3.
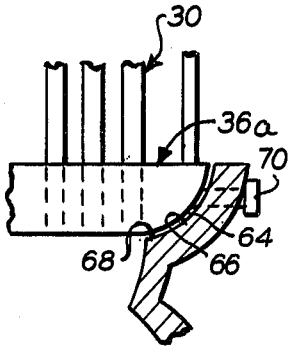
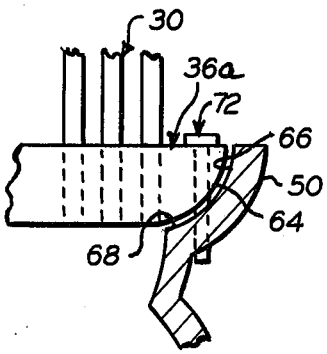
FIG. 4.

MODULAR STEAM GENERATOR FOR USE IN NUCLEAR POWER PLANTS

BACKGROUND OF THE INVENTION

1. Field of the Invention

The present invention relates to steam generators and particularly to such steam generators for use in nuclear power plants.

2. Description of the Prior Art

Steam generators for use in power plants, and particularly for use in nuclear power plants are well known, such as the type of steam generator manufactured by Westinghouse. One such typical prior art steam generator is shown in FIG. 1 of the drawings. These prior art steam generators utilized in nuclear power plants are normally contained in a containment building, such as one made of concrete. Moreover, these prior art steam generators known to applicant are unitary structures comprising a housing having an upper shell and lower shell portion with a moisture separator, including a swirl vane moisture separator, normally being located in the upper shell portion and with a tube bundle normally being located in the lower shell portion. In such prior art steam generators presently employed in nuclear power plants, the steam generator is completely enclosed and is placed in the containment building prior to the concrete being poured. As a result, once the containment building is sealed there is no way to replace this steam generator without breaking or destroying the containment building. Accordingly, if there is a failure in the tube bundle, it has heretofore been necessary to break the containment building in order to repair the steam generator as that is the only manner in which access can be had to various portions of the steam generator. Moreover, failure in the tube bundle of this prior art unitary type of steam generator has required replacement of the entire steam generator in order to allow for such repair, which complete replacement is quite costly in that such a steam generator costs approximately $15,000,000 by 1976 standards.

With the widespread acceptance and use of nuclear power plants, there have been more and more such tube failures in the tube bundles of such steam generators which have required the power plant to be shut down. This, of course, can be extremely costly inasmuch as the steam generators are a vital component in the operation of the nuclear power plant. Moreover, since such nuclear power plants normally include three or four such steam generators in operation, the cost of replacement and/or repair can become quite prohibitive.

Although the use of modular housing in various types of heat exchangers has been well known, such as disclosed in U.S. Pat. Nos. 1,372,010; 2,228,549; 2,241,209; 1,564,446; 1,790,897; 973,610; 514,338 and 784,192, such techniques, to applicant's knowledge, have not been used with respect to steam generators and particularly steam generators for use in nuclear power plants, despite the serious problems encountered with respect to repair and/or replacement of these steam generators in situ. These disavantages of the prior art are overcome by the present invention.

SUMMARY OF THE INVENTION

An improved steam generator for use in a nuclear power plant of the pressurized water type in which a turbine generator is driven by the steam output of the steam generator to provide electrical power therefrom and the steam generator is powered by a nuclear energy heat source, comprises a vertically assemblable modular structure for the steam generator. The modular structure comprises a base module, a tube bundle module removably mountable on the base module in sealing relationship therewith and an uppermost dryer module removably mountable on the tube bundle module in sealing relationship therewith for providing the vertically assemblable modular structure. The vertically assembled base module and tube bundle module comprise the lower housing portion of the steam generator and the dryer module comprises the upper housing portion of the steam generator.

The dryer module has a steam outlet at one end thereof which is communicable with the turbine for providing steam generated within the steam generator to the turbine and a mositure separator means within the interior thereof in communication with the steam outlet for drying the generated steam provided to the steam outlet. The other end of the dryer module has a closure flange. The tube bundle module has a closure means, such as a closure flange, at the upper end thereof and a closure flange at the lower end thereof and contains a vertically extending tube bundle therein through which heat exchange fluid flows for enabling the provision of the steam. The tube handle has a tube sheet at one end thereof for supporting the tube bundle with the tubes comprising the tube bundle extending through the tube sheet in flow through communication with heat exchange fluid provided thereto. The tube bundle module also contains a feedwater inlet through which feedwater is provided for conversion into steam. The tube sheet comprises the lower end closure flange of the tube bundle module. The dryer module closure flange and the tube bundle module upper closure means effectuate the aforementioned sealing relationship between the tube bundle module and the dryer module.

The base module uppermost portion has an outer shell having a tapered interior wall with the base module having the heat exchange fluid inlet therein which is in flow through communication with the vertically assembled tube module tube bundle. The exterior surface of the tube sheet closure flange is tapered complementary to the base module outer shell interior wall tapered portion and removably receivable therein for forming the aforementioned sealing relationship between the tube bundle module and the base module, with the associated weight of the vertically assembled dryer module and tube bundle module on the tube sheet closure flange effectuating the sealing relationship between the base module and the tube bundle module for facilitating closure by the tube sheet closure flange, whereby ready access to and removal of the tube bundle module in situ from the nuclear power plant steam generator is facilitated. Thus, the entire associated weight of the vertically assembled dryer and tube bundle modules is supported on the base module. Removable locking means are provided for lockably retaining the modules comprising the steam generator in vertically assembled relation. The vertically assembled modular nuclear steam generator is contained within a containment building structure therefor and may be disassembled for enabling repair of the steam generator without breaking or destroying the containment building structure.

BRIEF DESCRIPTION OF DRAWINGS

FIG. 2 is a diagrammatic illustration, partially in section, of a modular vertically assembled steam generator in accordance with the present invention in situ in a containment building in a nuclear power plant;

FIG. 3 is a fragmentary diagrammatic illustration, partially in section, of the manner of locking the closure flange arrangement between the tube bundle module and the base module of the embodiment of FIG. 2;

FIG. 4 is a view similar to FIG. 3 of an alternative embodiment for removably locking the closure arrangement of FIG. 3;

DETAILED DESCRIPTION OF PREFERRED EMBODIMENTS

Figure 1:
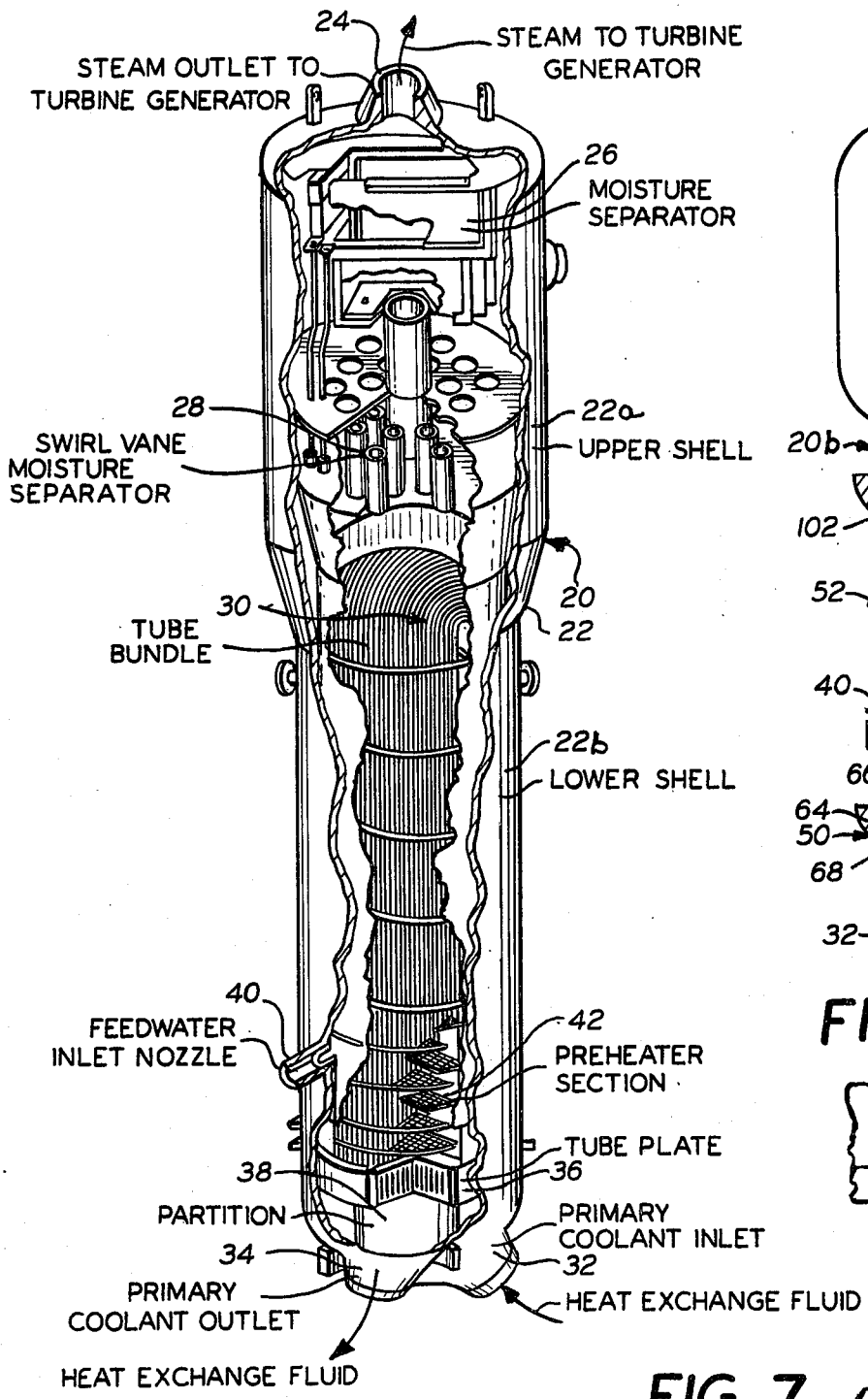
FIG. 1. PRIOR ART
FIG. 1 is a cut away view in perspective of a prior art typical steam generator of the type used in nuclear power plants.

Referring now to the drawings in detail, and initially to FIG. 1 thereof, FIG. 1 is a cut away view, in perspective, of a typical conventional steam generator of the type used in nuclear power plants of the pressurized water type. In such power plants, the steam generator, generally referred to by the reference numeral 20, provides steam to a conventional turbine generator (not shown) which is powered thereby to provide electrical power therefrom in conventional fashion. In such nuclear power plants, an atomic reactor provides the nuclear energy heat source which ultimately "powers" the steam generator 20, such a nuclear reactor not being shown in FIG. 1. As shown in FIG. 1, the conventional prior art steam generator 20 includes an outer housing or shell 23 comprising an upper shell portion 22*a* and a lower shell portion 22*b*. As shown in FIG. 1, this shell or housing 22 is conventionally fabricated as an integral structure. As is well known, such steam generators 20 for use in nuclear power plants are normally vertically arranged in use in the manner shown in FIG. 1 and are preferably contained within a containment building, such as one preferably formed of concrete. Such a containment building is not shown in FIG. 1 but is illustrated in FIG. 2 which refers to the preferred embodiment of the steam generator 20*a* of the present invention.

Referring once again to FIG. 1, at the upper portion of the steam generator 20, namely the upper portion of the upper shell 22*a*, a steam outlet 24 is provided which is coupled in flow through communication with the turbine generator (not shown) for providing the aforementioned steam thereto. The upper shell portion 22*a* also preferably contains a conventional moisture separator 26 and a conventional swirl vane moisture separator 28 for drying the steam prior to its provision to the steam outlet 24. The lower shell portion 22*b* of the conventional steam generator 20 preferably contains a conventional tube bundle 30 through which heat exchange fluid normally flows. The heat exchange fluid is normally provided to the tube bundle 30 through a conventional inlet 32 therefor and flows out of the steam generator 20 through a conventional outlet 34 therefor. The heat exchange fluid inlet 32 and outlet 34 are in flow through communication with the tube bundle 30. The tube bundle 30 is conventionally supported in a conventional tube plate or tube sheet 36 through which the tubes comprising the tube bundle 30 extend so as to be in flow communication with the heat exchange fluid inlet and outlet 32 and 34, respectively. A conventional partition 38 is provided to separate the heat exchange fluid flowing through the inlet 32 from the heat exchange fluid flowing through the outlet 34. Feedwater which is conventionally converted into steam by steam generator 20 is preferably fed thereto through a conventional feedwater inlet nozzle 40 contained in the lower shell portion 22*b*. As also illustrated in FIG. 1, the tube bundle 30 also contains a conventional pre-heater section 42. Since the operation of the steam generator 20 is conventional, it will not be described in greater detail hereinafter. Suffice it to say that steam generator 20 may by any typical conventional steam generator, such as the type conventionally manufactured by Westinghouse for use in nuclear power plants of the pressurized water type.

Referring now to FIG. 2, a diagrammatic representation of the preferred embodiment 20*a* of the modular steam generator of the present invention is shown. Identically functioning components in the modular steam generator 20*a* which are identical with the those previously described with reference to FIG. 1 have the same reference numerals as used in FIG. 1. Thus, as can be seen in FIG. 2, the primary and significant difference between the steam generator 20*a* of FIG. 2 and the steam generator 20 of FIG. 1 is in the modular arrangement. As shown and preferred in FIG. 2, modular steam generator 20*a* preferably consists of three separate and distinct modules 50, 52 and 54. Module 50 is termed the base module and, as will be described in greater detail hereinafter, is the portion of the modular steam generator 20*a* which supports the entire weight of modules 52 and 54 vertically assembled thereabove. Module 52 is termed the tube bundle module which is vertically assembled above the base module 50 and supported thereon. Tube bundle module 52 preferably contains the tube bundle 30, the feedwater inlet 40, the aforementioned pre-heater section 42 if such is utilized, and the aforementioned tube plate or tube sheet 35*a*. As will be described in greater detail hereinafter, tube bundle module 52 is vertically assembled on base module 50 and supported thereon in sealing relationship with the tubes comprising the tube bundle 30 preferably being in flow through communication with the heat exchange fluid inlets and outlets 32 and 34, respectively. The heat exchange fluid inlets and outlets 32 and 34, respectively, are preferably contained in the base module 50 as is, of course, the partition 38 therebetween.

As also shown and preferred in FIG. 2, the tube sheet or tube plate 36*a* preferably forms a closure flange at the lower portion of tube bundle module 52 as well as serving as the tube plate for tube bundle 30. A separate closure flange 56 is located at the uppermost end of tube bundle module 52 for effectuating sealing relationship between tube bundle module 52 and dryer module 54. This sealing relationship is effectuated by a mating relationship between closure flange 56 of tube bundle module 52 and a closure flange 58 located at the bottom or lowermost portion of dryer module 54. The steam outlet 24 is located in the uppermost portion of dryer module 54. Moreover, as shown and preferred, dryer module 54 contains the moisture separator 26 and the swirl vane moisture separator 28 within the interior thereof, with separators 26 and 28 being arranged in flow through communication with the steam provided from the tube bundle module 52 when the modular steam generator 20a is vertically assembled as shown in FIG. 2. With respect to the interconnection between the dryer module 54 and the tube bundle module 52, if desired, conventional locking means, such as threaded bolts 60 and 62 by way of example, may extend through the mated closure flanges 56 and 58 to retain them in vertically assembled position, with these bolts 60 and 62 being removed when it is desired to separate the dryer module 54 from the tube bundle module 52.

With respect to the sealing relationship between the tube bundle module 52 and the base module 50, this is preferably accomplished by providing the exterior surface 64 of the tube sheet 36a with a taper which is complementary to a taper provided in the interior wall 66 of the upper portion of base module 50. In addition, as shown and preferred in FIGS. 2 through 4, this upper portion of base module 50 is preferably formed with a lip 68 upon which the bottom of the tube sheet 36a rests. The complementary tapers 64 and 66 are such that these surfaces are mateable so as to provide the aforementioned sealing relationship. If desired, a gasket, such as one formed of a metallic substance, can be provided between these mateable surfaces 64 and 66 so as to effectuate a tighter seal.

As shown and preferred in FIG. 3, although the associated weight of the vertically assembled dryer module 54 and tube bundle module 52 on the tube sheet 36a is sufficient to effectuate the aforementioned sealing relationship, locking means are preferably provided for insuring that the tube bundle module 52 and the base module 50 remain intact in vertically assembled relation. As shown in FIG. 3, such a locking means may comprise a threadable bolting means 70 which is threaded through the wall of base module 50 so as to bear against exterior surface 64 in a friction engagement, with the bolts 70 bearing against this exterior surface 64 from opposite sides as illustrated in FIG. 2. In addition, if desired, a threaded hole can be provided in the respective sides of the tube plate 36a for allowing the bolts 70 to extend thereinto.

FIG. 4 illustrates an alternative embodiment for locking the tube sheet 36a to the base module 50. In the embodiment of FIG. 4, a vertically extendable bolt 72 is vertically threaded through the tube sheet 36a and therefrom through the lip portion 68 of the base module 50.

Dryer module 54 of the modular steam generator 20a preferably comprises the equivalent of the upper shell portion 22a of steam generator 20 shown in FIG. 1, and the tube bundle module 52 and base module 50, taken together, when vertically assembled preferably comprise the equivalent of lower shell portion 22b of the steam generator 20 of FIG. 1. Moreover, as illustratively shown in FIG. 2 the modular steam generator 20a is preferably contianed in a concrete containment building 80. Thus, in vertically assembling the modular steam generator 20a, as well as disassembling the steam generator 20a, the lifting, and hence, assembly, operations must take place from above so as not to destroy the containment building 80. The base module 50 is normally permanently mounted within the containment building 80 for enhanced support. The tube bundle module 52 may then be vertically lowered down into position in base module 50 with the weight of the tube bundle module 52 on the tube sheet 36a helping to effectuate the sealing relationship between the mating surfaces 64 and 66 and with the tube sheet 36a resting on lip 68. Of course, during initial assembly, the containment building 80 could be constructed after assembly of the steam generator 20a. The dryer module 54 is then vertically lowered onto closure flange 56 so that closures flanges 58 and 56 are in mating relationship with any through hole threaded apertures required for bolts 60 and 62. Thereafter, locking means 70, 60 and 62 may be inserted to hold the vertically assembled modules 54, 52 and 50 in vertically assembled relation. Similarly, when it is desired to disassemble the modular steam generator 20a so as to repair any of the various component parts thereof, the locking means 60, 62 and 70 are removed and then the dryer module may be vertically lifted away from the tube bundle module 52 and, thereafter, the tube bundle module 52 may be vertically lifted away from base module 50 and out of the containment building 80 without destroying the containment building. Such vertical lifting can conventionally be accomplished by the type of aerial cranes normally in use in such conventional nuclear power plants. Arrows 82 and 84 illustrate the vertical directions for removal and assembly of the modules 54 and 52 to base module 50.

Figure 5:
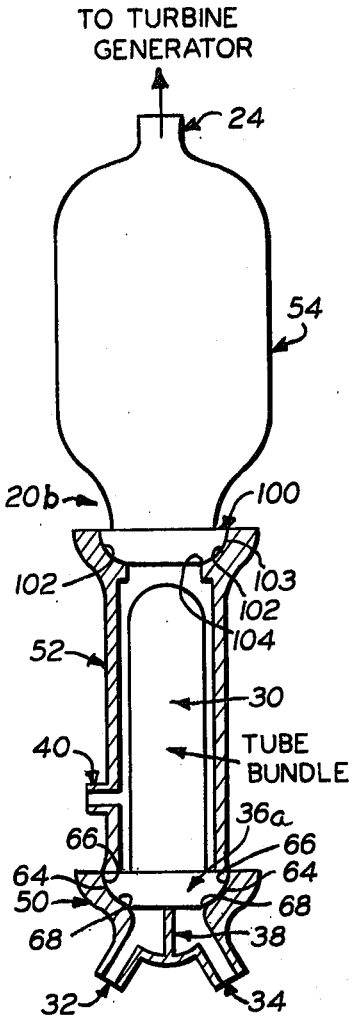
FIG. 5 is a diagrammatic illustration, partially in section, similar to FIG. 2, of an alternative embodiment for providing the sealing relationship between the dryer module and the tube bundle module.
Figure 6:
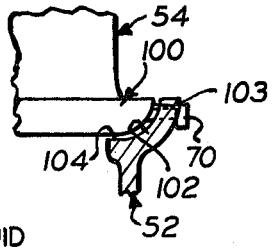
FIG. 6 is a view similar to FIG. 3 of the locking arrangement between the dryer module and tube bundle module in the embodiment of FIG. 5.
Figure 7:
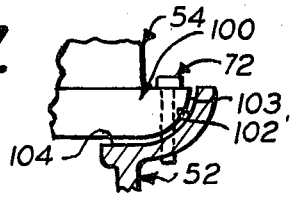
FIG. 7 is a view similar to FIG. 4 of an alternative embodiment of the locking arrangement of FIG. 6.

Referring now to FIG. 5, an alternative embodiment of the modular steam generator 20a of FIG. 2 is shown, with this embodiment being designated by the reference numeral 20b. Preferably, modular steam generator 20b is identical with modular steam generator 20a except for the manner of effectuating the sealing relationship between dryer module 54 and tube bundle module 52. Thus, closure flanges 56 and 58 of modular steam generator 20a are replaced by a tapered closure flange 100 at the bottom of dryer module 54 and a complementary tapered interior wall portion 102 at the uppermost portion of tube bundle module 52. The relationship between the tapered closure flange 100, having a tapered exterior surface 103 which is complementary to the tapered interior surface 102 of the uppermost portion of tube bundle module 52, is preferably functionally identical to that previously described with reference to the relationship between surfaces 64 and 66. Thus, in addition to the mating relationship between surfaces 102 and 103, a lip 104 similar to lip 68 is also provided upon which the bottom surface of closure flange 100 rests. In addition, if desired, a gasket, such as a metallic substance gasket, may be provided between mateable surfaces 103 and 102 for further effectuating the sealing relationship therebetween. Thus, in the arrangement of FIG. 5, the associated weight of the dryer module 54 upon closure flange 100 effectuates the aforementioned sealing relationship. FIGS. 6 and 7 illustrate arrangements similar to FIGS. 3 and 4, respectively, for locking the tapered closure flange 100 to the tube bundle module 52.

FIG. 6 illustrates employment of the locking means 70 previously described with reference to FIG. 3 for locking the tapered closure flange 100 of dryer module 54 to the tube bundle module 52, which locking may be accomplished in the identical manner previously described with reference to FIG. 3. Similarly, FIG. 7 illustrates the use of locking means 72 for locking the closure flange 100 of dryer module 54 to the tube bundle module 52 through lip 104, with such locking being accomplished in the identical manner as previously described with reference to FIG. 4. Thus, in the modular steam generator 20*b* illustrated in FIG. 5, the associated weight of the dryer module 54 on closure flange 100 effectuates the sealing relationship between the dryer module 54 and the tube bundle module 52, and the combined associated weight of dryer module 54 and tube bundle module 52 on the tube sheet 36*a* closure flange effectuates the sealing relationship between tube bundle module 52 and base module 50 in the vertically assembled modular steam generator 20*b*.

By utilizing the modular steam generator of the present invention, which is used in nuclear power plants of the pressurized water type, ready access to and removal of the tube bundle module in situ from the nuclear power plant steam generator without destruction of the containment building may be accomplished, a modular steam generator may be provided in which all of the primary piping may remain intact, and the entire weight of the vertically assembled modular steam generator may be supported from the base module therefor.

What is claimed is:

1. In a steam generator for use in a pressurized water nuclear power plant in which a turbine generator is driven by the steam output of said steam generator to provide electrical power therefrom, wherein said steam generator comprises a vertically extending hollow outer housing having an upper housing portion and a lower housing portion, with said upper housing portion having a steam outlet therein communicable with the turbine generator for providing steam generated within said steam generator to said turbine generator and a moisture separator means within the interior thereof in communication with said steam outlet for drying the generated steam provided to said steam outlet, and with said lower housing portion having heat exchange fluid and feedwater inlets and a vertically extending tube bundle within the interior thereof in flow through communication with said heat exchange fluid inlet for enabling heat exchange fluid provided through said inlet therefor to flow through said tube bundle for providing said generated steam from feedwater provided through said inlet therefor, said tube bundle having a tube sheet at one end thereof for supporting said tube bundle with the tubes comprising said tube bundle extending through said tube sheet in said flow through communication with said heat exchange fluid inlet; the improvement comprising a base module, a tube bundle module removably mountable on said base module in sealing relationship therewith, and an uppermost dryer module removably mountable on said tube bundle module in sealing relationship therewith for providing a vertically assemblable modular structure for said steam generator, said vertically assembled base module and tube bundle module comprising said lower housing portion, and said dryer module comprising said upper housing portion, said dryer module having said steam outlet at one end thereof and a closure flange at the other end thereof and having said moisture separator means within the interior thereof, said tube bundle module having a closure means at the upper end thereof and a closure flange at the lower end thereof and containing said tube bundle within the interior thereof with said tube sheet comprising said lower end closure flange, said dryer module closure flange and said tube bundle module upper closure means effectuating said sealing relationship between said tube bundle module and said dryer module, said base module uppermost portion comprising an outer shell having an arcuately tapered interior wall forming an arcuate lip portion with said base module having said heat exchange fluid inlet therein, said tube bundle in said vertically assembled tube bundle module being in said flow through communication with said heat exchange fluid inlet, the exterior surface of said tube sheet closure flange being arcuately tapered complementary to said base module outer shell interior wall arcuately tapered portion and removably insertable therein in self-supporting bearing relationship against said lip portion for effectuating said sealing relationship between said tube bundle module and said base module essentially as a result of the associated weight of said vertically assembled dryer module and said tube bundle module bearing on said tube sheet closure flange and being supported on said base module while simultaneously facilitating closure by said tube sheet closure flange, whereby ready access to and removal of said tube bundle module in situ from said nuclear power plant steam generator is facilitated.

2. A modular nuclear power plant steam generator in accordance with claim 1 wherein said entire associated weight of said vertically assembled dryer and tube bundle modules is supported on said base module.

3. A modular nuclear power plant steam generator in accordance with claim 1 wherein said tube bundle module contains said feedwater inlet therein.

4. A modular nuclear power plant steam generator in accordance with claim 1 wherein said dryer module closure flange comprises a flange having an arcuately tapered exterior surface and said tube bundle module comprises an outer shell with said upper end closure means comprising an arcuately tapered interior wall in said outer shell, said dryer module flange tapered exterior surface being arcuately tapered complementary to said tube bundle module outer shell arcuately tapered interior wall and removably insertable therein in self-supporting bearing relationship against said arcuately tapered interior wall for effectuating said sealing relationship between said dryer module and said tube bundle module essentially as a result of the associated weight of said vertically assembled dryer module bearing on said dryer module closure flange and being supported on said tube bundle module while simultaneously facilitating closure by said dryer module closure flange.

5. A modular nuclear power plant steam generator in accordance with claim 4 further comprising locking means for removably locking said vertically assembled dryer module to said vertically assembled tube bundle module and said vertically assembled tube bundle module to said base module for removably maintaining said modules in vertically assembled relation.

6. A modular nuclear power plant steam generator in accordance with claim 5 wherein said removable locking means comprises vertically removable bolting means.

7. A modular nuclear power plant steam generator in accordance with claim 1 further comprising locking means for removably locking said vertically assembled dryer module to said vertically assembled tube bundle module and said vertically assembled tube bundle module to said base module for removably maintaining said modules in vertically assembled relation.

8. A modular nuclear power plant steam generator in accordance with claim 7 wherein said removable locking means comprises vertically removable bolting means.

* * * * *